United States Patent [19]

Platt

[11] 4,269,308

[45] May 26, 1981

[54] MULTI-UNIT CONTAINER PACKAGE

[75] Inventor: John R. Platt, Wheaton, Ill.

[73] Assignee: Illinois Tool Works Inc., Chicago, Ill.

[21] Appl. No.: 121,617

[22] Filed: Feb. 14, 1980

[51] Int. Cl.[3] ..... B65D 71/00; B65D 85/62

[52] U.S. Cl. ..... 206/150; 206/427; 229/52 B; 294/87.2

[58] Field of Search ..... 206/150, 161, 427; 229/52 B; 294/87.2, 87.26

[56] References Cited

U.S. PATENT DOCUMENTS

| | | | |
|---|---|---|---|
| 2,994,426 | 8/1961 | Biesecker et al. | 294/87.2 |
| 3,084,792 | 4/1963 | Poupitch | 206/150 |
| 3,181,766 | 5/1965 | Kane et al. | 206/150 |
| 3,302,783 | 2/1967 | Lyon | 206/427 |
| 3,307,321 | 3/1967 | Beart | 229/52 B |
| 3,515,272 | 6/1970 | Von Gal | 206/192 |
| 3,653,504 | 4/1972 | Saumsiegle | 206/161 |

*Primary Examiner*—William T. Dixson, Jr.
*Attorney, Agent, or Firm*—Thomas W. Buckman

[57] ABSTRACT

A portable container package for a relatively large number of can-like containers comprising the combination of the plurality of containers arranged in ranks and rows interconnected or partially interconnected by a packaging device resiliently engaging the top portion of the containers against chime regions and a unitary, endless band resiliently encircling the array, and more particularly providing a carrying member integral with the band and unconnected to the top engaging packaging device.

7 Claims, 5 Drawing Figures

MULTI-UNIT CONTAINER PACKAGE

BACKGROUND AND SUMMARY OF THE INVENTION

The invention concerns generally a package for a plurality of can-type containers and more particularly a package for a large plurality of such containers, for example 12, which can be carried comfortably and reliably.

A typical multipackage for can-type containers, as shown for example in U.S. Pat. Nos. 2,874,835 and 3,874,502, includes a sheet plastic device having a plurality of integrally interconnected bands creating apertures equal in number to the number of containers to be packaged thereby adapted to be placed about the tops of containers so that the bands resiliently engage the top portions directly adjacent the chime or enlarged lid portion of the containers. Such carrier devices have been found to be convenient and highly advantageous in packaging groups of containers numbering six or less. More recently, this concept has been suggested for integrally packaging larger numbers of containers. For example, U.S. Pat. No. 4,018,331 shows such an integral carrier device for packaging 12 containers.

Other efforts to package containers in numbers more than six have typically included paperboard or plastic film totally overwrapping 12 loose containers. These techniques are generally complicated and expensive to apply and either completely package or completely unpackage the containers.

In packaging a large number of containers, such as 12, it has been found that such a package, as created by prior art techniques, is rather large, heavy and cumbersome to be easily handled.

It is, accordingly, an object of the invention to provide a package which is easy to handle and which minimizes the risk of accidental removal of one or more containers from the package without requiring a total encapsulation of the array of containers.

A further object of this invention is to provide a package of 12 or more containers which is tightly unitized and which presents an easily handled package which may be readily identified relative to packages of lesser numbers of similar containers.

In keeping with these objects, the invention will be shown to basically include an upper carrier device retaining all or selected numbers of the top regions of the containers and a second carrier device spaced from and totally unconnected to the first device consisting of a resilient band encircling the array and which includes an integral handle. The package is so designed that the package can be carried without producing a force on any or all of the cans tending to remove them from the first package making device.

Other objects and advantages will become apparent from the following description when taken in connection with the accompanying drawings wherein:

DETAILED DESCRIPTION OF THE PREFERRED EMBODIMENTS

Figure 1:
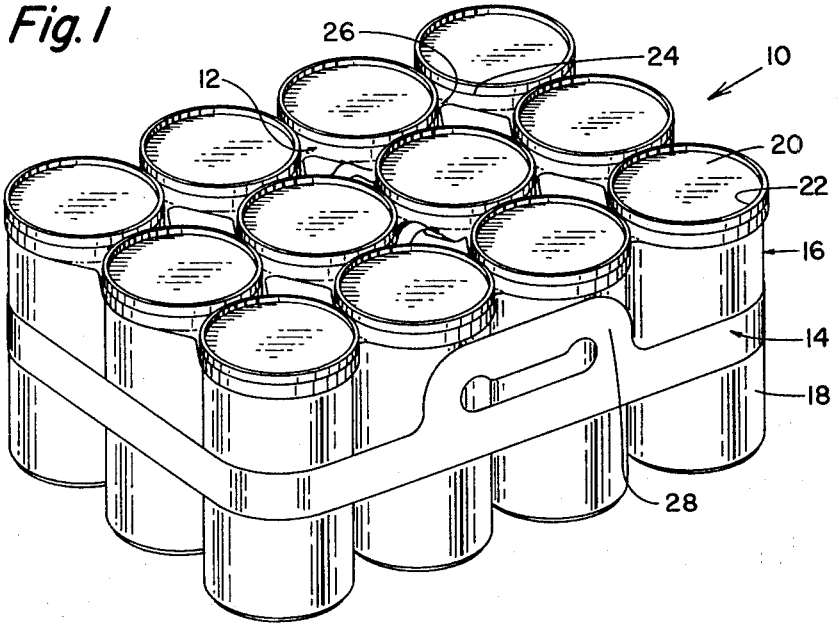
FIG. 1 is a perspective view of the container package of the invention.
Figure 2:
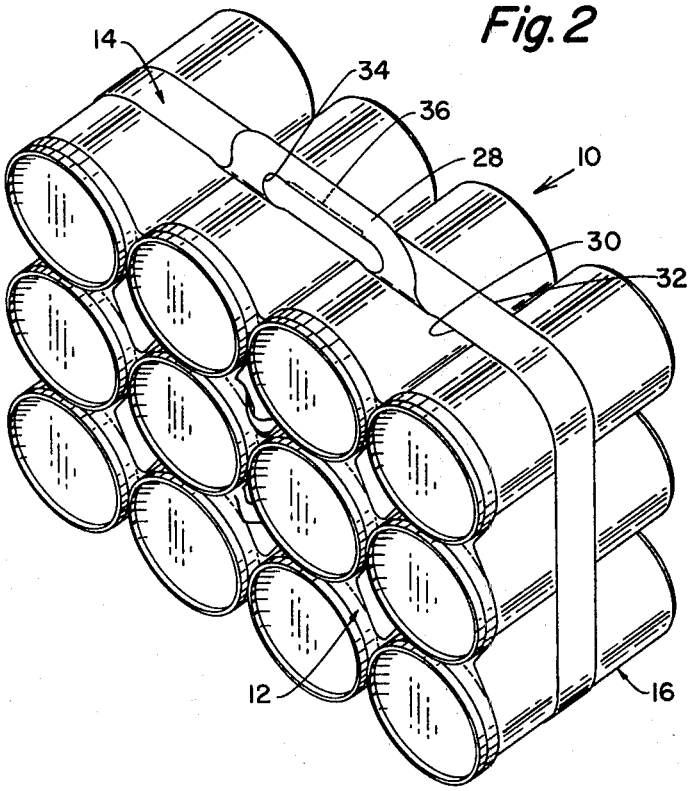
FIG. 2 is a different perspective view of the container package of the invention shown in FIG. 1.
Figure 4:
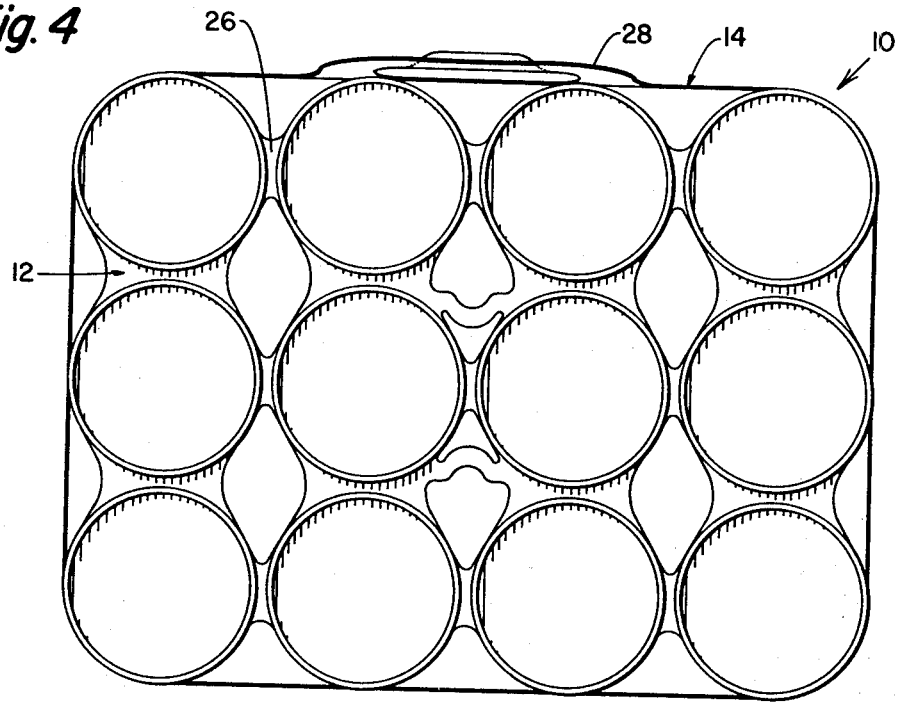
FIG. 4 is a top plan view of the preferred embodiment of the container package of the invention.

Referring now in greater particularity to the drawings and first FIGS. 1, 2 and 4, it will be shown that the package 10 of the invention includes a first packaging device 12 and a second packaging device 14 cooperating to unitize a plurality of containers 16.

Typical containers which are effectively packaged using this invention are the can-type containers having a cylindrical sidewall 18, a top lid 20 and an annular chime 22 forming the perimeter of the top lid. While the can may have the sidewall extend directly to the chime, current popular container manufacturing process involves at least one indentation or necked in region adjacent the chime. In any event, the top carrier 12 is designed to resiliently engage beneath the chimes to unitize a predetermined plurality of such containers.

The first, or top, packaging device 12, in the preferred embodiment, is a strip-like thermoplastic device, typically polyethylene, having a plurality of apertures 24 interconnected by web regions 26. The apertures 24 will be smaller in circumference than the region of the can which they are to be associated with so that they resiliently engage and retain the container therein. Typical examples of such packaging devices are shown in U.S. Pat. No. 4,018,331. It should be noted that the preferred device 12 is designed to package 12 containers in a single, unitized compact package, with an array of four ranks of three rows.

The second device 14 is an endless band of resilient thermoplastic material, typically polyethylene. Band 14 will have a predetermined width and thickness, with the thickness being substantially less than the width. The band will be dimensioned so that it will be in a slightly stretched condition when encircling the array to create a unitizing pressure on the sidewalls of the containers.

The band is preferably located midway of the extremities of the containers and the width of the band is positioned to be generally parallel the axes of the containers to create at least a small amount of surface area contact with all the outermost containers in the array.

Figure 3:
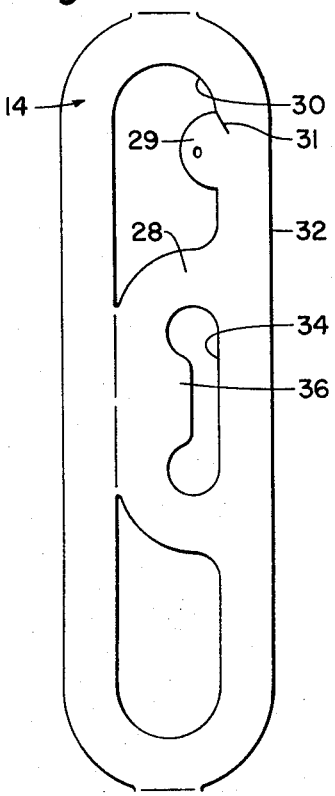
FIG. 3 is a top plan view of one form of an endless band blank to be utilized with the container package of the invention.

Turning to FIG. 3, a representative manner of producing such an endless band 14 is shown. The band can economically be punched from a flat strip of raw material by designing an elongated blank with the handle portion 28 extending inwardly of the periphery of the inner edge 30 of the band. It should be noted from the perspective views in FIGS. 1 and 2 that inner edge 30 will be under slightly greater tension than the outer edge 32, since it must be stretched a slightly greater amount to permit the band to lie flat or to lie generally parallel to the axes of the containers. This provides a unique advantage than when the package is grasped as by pulling the handle 28 up as shown in FIG. 2. A greater resistance to the pulling force is created by the slightly higher tension of the inner edge area 30 than if the handle 28 were located at the outer edge band 32. This feature thus tends to stabilize the package in general and permits the handle to lie substantially flat against the containers when not in use.

It should be particularly noted that with the handle integral with the band surrounding the array, no carrying forces are exerted on any of the individual container receiving apertures in the first carrier. Thus, first packaging device 12 can be greatly reduced in weight since it does need only to unitize the package in ranks and rows to prevent skewing and does not have to be necessarily designed to carry or accept the load of the total package. The second packaging device 14 thus serves to accept the carrying load without transmitting the load to the top packaging device.

An apparant advantage of the band device 14 is identification as a 12-pack as compared to 6-packs which are packaged solely by a top packaging device. Band 14 also makes premature removal of one or more of the containers packaged very difficult. It should be apparent that predetermined weakened areas may be placed in the band to facilitate consumers removal of the band to remove individual containers. For example, tab 29 with slit 31, shown in FIG. 3 could be utilized to facilitate removal of band 14.

Figure 5:
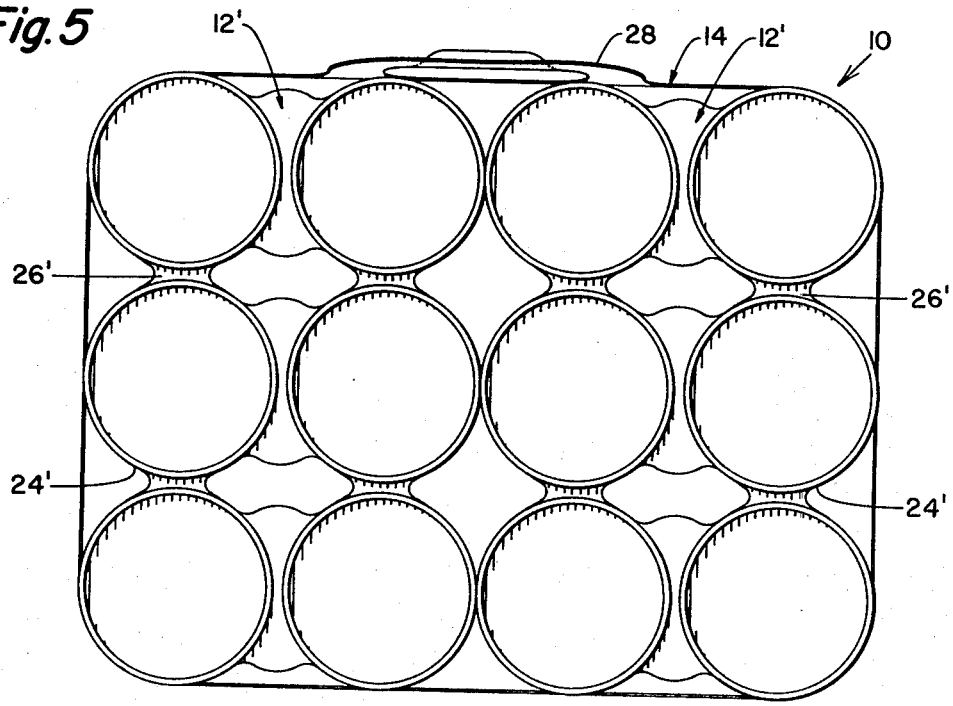
FIG. 5 is a top plan view of a modification of the container package of the invention.

It should be apparent that while a preferred embodiment shows a single integral device for unitizing the top regions of 12 containers, a pair of 6 unitized containers can also be packaged using the basic concepts of this invention. For example, as shown in FIG. 5, two identical six-packs of containers can be placed side by side to produce a composite array substantially identical to the array shown in FIG. 4. In such an embodiment, the two top gripping carrier devices 12' can be constructed in accordance with the general teachings of any of the prior U.S. Pat. Nos. 2,874,835—3,874,502 or the smaller unit package shown in the aforementioned U.S. Pat. No. 4,018,331 to include six apertures 24' integrally connected by webs 26'. It has been found that two such units of packages can be rigidly unitized in a single package using a band 14 in accordance with the invention.

While not shown, it should be apparent that several units of pluralities of containers can be packaged also by vertically stacking either 6-packs or 12-packs together and utilizing the teachings of this invention. A preferred manner of doing so would be to place the lids 20 face to face thereby permitting the band of the invention, which probably should be wider than the band in these embodiments, to overlap the top regions of both arrays with the chime regions centering the band and mechanically locating the band.

From the foregoing, it will now be apparent that the present invention contemplates a novel and unique package for effectively unitizing and retaining and preventing lateral shifting of a large number of containers. The invention is primarily directed to an efficient package for 12 containers. While the preferred embodiment of the present invention has been shown and described herein, it is obvious that many structural details may be changed without departing from the spirit and scope of the appended claims.

I claim:

1. A package for a plurality of can-type containers including, in combination, a plurality of containers arranged in an array of rows and ranks, each container including generally cylindrical side walls interconnected to top regions which incorporate radially extending chime means with a predetermined perimeter dimension, a first discrete packaging means comprising a plurality, equal in number to the said plurality of containers, of interconnected, resilient, container encircling bands each of which being adapted to be positioned beneath the chime means of an associated container in resilient engagement therewith, a second packaging means, spaced downwardly from the first packaging means and unconnected thereto, comprising an endless resilient band encircling the array, the band having a predetermined width dimension substantially greater than the thickness of the band, the band configured so that the width dimension extends generally parallel to the axes of the containers, an integral handle means formed outwardly of one segment of an edge of said band, said handle adapted to lie flat against the array when not in use, the combination providing a unitized package with handling means disassociated from the top engaging packaging means.

2. The package of claim 1, wherein the array comprises 12 containers arranged in four ranks of three rows.

3. The package of claim 2, wherein the first package means is a single device with twelve integrally interconnected container encircling bands.

4. The package of claim 2, wherein the first package means comprises a pair of discrete devices each with six integrally interconnected container encircling bands.

5. The package of claim 1, wherein the band is located substantially midway the top portions and bottom portions of the containers in the array.

6. The package of claim 1, wherein the band is formed from flat sheet material, the handle extending inwardly from the inner peripheral edge of the band so that the band when applied will provide an edge connected to the handle stretched slightly more than the opposite edge.

7. The package of claim 1, wherein the band includes means to facilitate removal of said band from the package.

* * * * *